United States Patent [19]

Pratt

[11] Patent Number: 4,592,177

[45] Date of Patent: Jun. 3, 1986

[54] COLUMN-MOUNTED APPLIANCES

[75] Inventor: John W. Pratt, Church Broughton, England

[73] Assignee: Abacus Municipal Limited, Nottinghamshire, England

[21] Appl. No.: 571,668

[22] Filed: Jan. 17, 1984

[30] Foreign Application Priority Data

Jan. 28, 1983 [GB] United Kingdom ..... 8302389

[51] Int. Cl.[4] ..... E04H 12/34

[52] U.S. Cl. ..... 52/116; 52/119; 362/401; 248/188.6

[58] Field of Search ..... 52/111, 116, 117, 118, 52/119, 28, 40, 29; 362/403, 402, 401, 431; 248/188.6; 403/61, 113–116; 404/9; 16/362, 363

[56] References Cited

U.S. PATENT DOCUMENTS

| | | | |
|---|---|---|---|
| 2,460,216 | 1/1949 | Dalton | 403/61 |
| 3,355,847 | 12/1967 | Pratt | 52/116 |
| 4,020,606 | 5/1977 | Pratt | 52/116 |

FOREIGN PATENT DOCUMENTS

| | | | |
|---|---|---|---|
| 2339851 | 11/1974 | Fed. Rep. of Germany | 52/116 |
| 2528751 | 1/1976 | Fed. Rep. of Germany | 52/119 |

*Primary Examiner*—John E. Murtagh

*Attorney, Agent, or Firm*—Charles E. Brown; Charles A. Brown

[57] ABSTRACT

An upper part of a column can be pivotally lowered and raised relative to a lower part thereof for servicing of an appliance mounted thereon. However, before the column part can be lowered it must be raised through a limited vertical displacement relative to the column part. A releasable locking device is provided to hold the column part at the upper end of this displacement, and comprises configurated slots which receive a rotatable pivot shaft. Each slot has relatively wide portions and a relatively narrow portion and the shaft is so shaped that it can pass into the narrow portion (and thereby permit said limited vertical displacement of the column part) only when it occupies a predetermined angular orientation.

24 Claims, 14 Drawing Figures

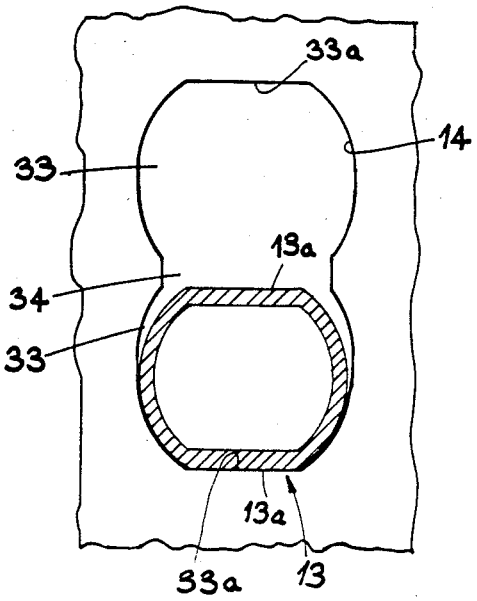
Fig. 7
Fig. 8
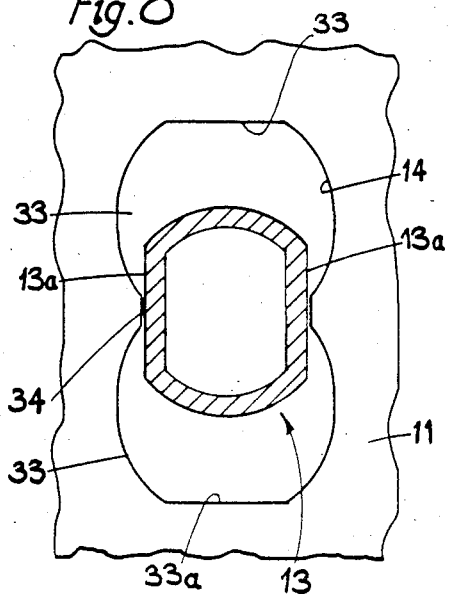
Fig. 9.
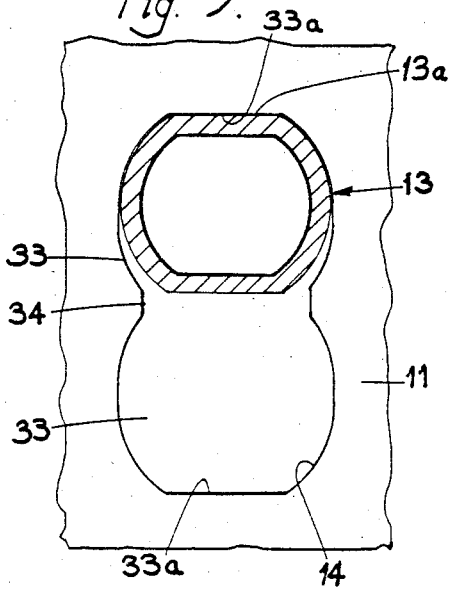

COLUMN-MOUNTED APPLIANCES

This invention relates to column-mounted appliances (such as street lighting columns) of the type wherein the appliance can be lowered for inspection and servicing by pivoting an upper part of the column relative to a lower part thereof.

In column-mounted appliances of this type, a mechanical interlock is generally provided which prevents the appliance from being lowered unless the upper column part is first displaced upwardly by a small amount relative to the lower column part. British Pat. No. 968113 discloses a street lighting column of this type wherein a pivot of the upper column part is incorporated into an eccentric cam, and the mechanical interlock is released by rotating the cam to raise the pivot and the upper column part together. It is however expensive to provide a separate cam arrangement on each column, which therefore increases the cost per unit of the appliance.

British Pat. No. 1460025, solves this problem to a certain extent by utilising an hydraulic ram to lift the upper column part to release the interlock with the lower column part, the hydraulic ram being incorporated into a counterbalance unit which is attached to the column as needed. In this case, the ram is also used to take the weight of the upper column part as the latter is pivotally lowered. However, for relatively light columns this weight can readily be taken by a compression spring or even by hand, and in these circumstances the provision of the ram represents an unnecessary expense.

It is an object of the present invention to overcome the above-described problem.

According to a first aspect of the present invention, a column-mounted appliance comprises a lower column part, an upper column part on which an appliance is mounted and which can be lowered and raised relative to the lower column part by pivotal movement about a generally horizontal pivot, the upper column part also being capable of limited vertical displacement relative to the lower column part, a mechanical interlock which prevents the upper column part from being pivotally lowered unless it is first moved through said limited vertical displacement from a lock position into a release position, and a releasable locking device to hold the upper column part in its release position, the locking device comprising at least one configurated slot in one of the column parts, the or each slot having a relatively narrow portion and a relatively wide portion, and a shaft which locates in said at least one configurated slot and which moves between said relatively narrow and wide portions as the upper column part is moved through said limited vertical displacement, the shaft having a non-circular external cross-section and being mounted on the other column part for rotation relative thereto between first and second positions wherein respectively it can and cannot enter the relatively narrow portion of the or each slot.

According to a second aspect of the invention, a column-mounted appliance comprises a lower column part, an upper column part on which an appliance is mounted and which can be lowered and raised relative to the lower column part by pivotal movement about a generally horizontal pivot, the upper column part also being capable of limited vertical displacement relative to the lower column part, a mechanical interlock which prevents the upper column part from being pivotally lowered unless it is first moved through said limited vertical displacement into a release position, and a lowering device attachable to the column to enable the upper part thereof to be lowered, the lowering device including first and second attachment portions which can be attached to the upper and lower column parts respectively, and a lever on which the first attachment portion is mounted and which is pivotable relative to the second attachment portion thereby to displace the first attachment portion and the upper column part vertically relative to the second attachment portion and the lower column part.

The invention will now be further described, by way of example only, with reference to the accompanying drawings, in which:

FIG. 7 is a section taken along the line A—A in FIG. 3, showing the pivot prior to a lowering operation;

FIGS. 8 and 9 are similar view to FIG. 7, but showing the pivot at various stages during the lowering operation;

Figure 1:
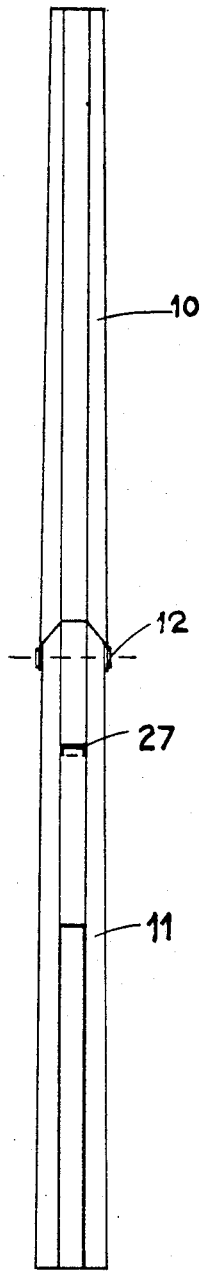
FIG. 1 is a front view of a first embodiment of a column-mounted appliance according to the present invention, with the appliance itself being omitted for the sake of convenience.
Figure 2:
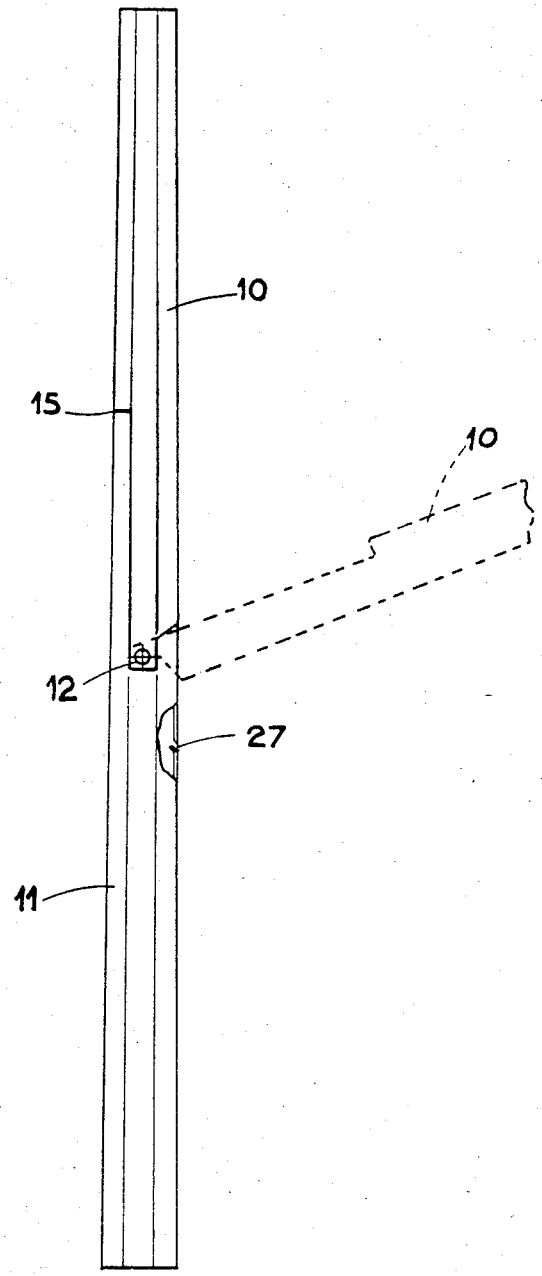
FIG. 2 is a side view (partly in section) of the column-mounted appliance shown in FIG. 1.
Figure 3:
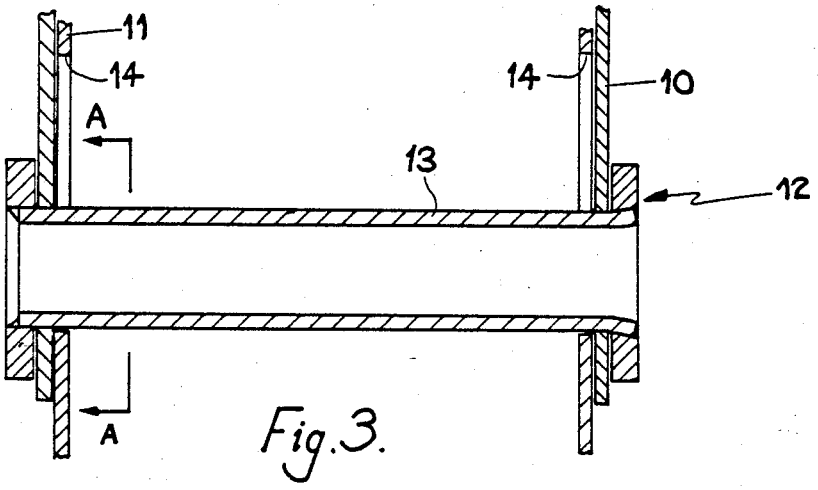
FIG. 3 is a cross-sectional view of a pivot which interconnects upper and lower column parts of the appliance.

FIGS. 1 and 2 illustrate a column for mounting an appliance (such as a lighting unit) at an elevated position, although for the sake of convenience the appliance itself is not shown. The column is composed of an upper part 10 on which the appliance is mounted and a lower part 11 which is secured to the ground, both of the parts 10 and 11 being of hollow octagonal cross-section in the illustrated embodiment although other cross-sections are possible. The upper part 10 is mounted on the lower part 11 so that it can be lowered and raised by being pivoted about a generally horizontal pivot 12, thereby enabling the appliance to be lowered to ground level for inspection and/or servicing. The upper part 10 is also capable of limited vertical displacement relative to the lower part 11, the limits of such displacement being defined by the engagement of a hollow shaft 13 of the pivot 12 with the respective ends of elongate slots 14 in the lower part 11 (see FIG. 3). When the columm part 10 is in a lock position at the lowermost point in this limited vertical displacement (i.e.when the pivot shaft 13 engages the bottom ends of the slots 14), an upper end of the column part 11 engages behind a lip 15 on the column part 10 and forms an interlock which prevents the column part 10 from being pivotally lowered. However, when the column part 10 is raised into a release position wherein the pivot shaft 13 engages the top ends of the slots 14, the lip 15 clears the end of the column part 11 and the column part 10 is free to be pivotally lowered in the manner indicated in broken line in FIG. 2.

Figure 4:
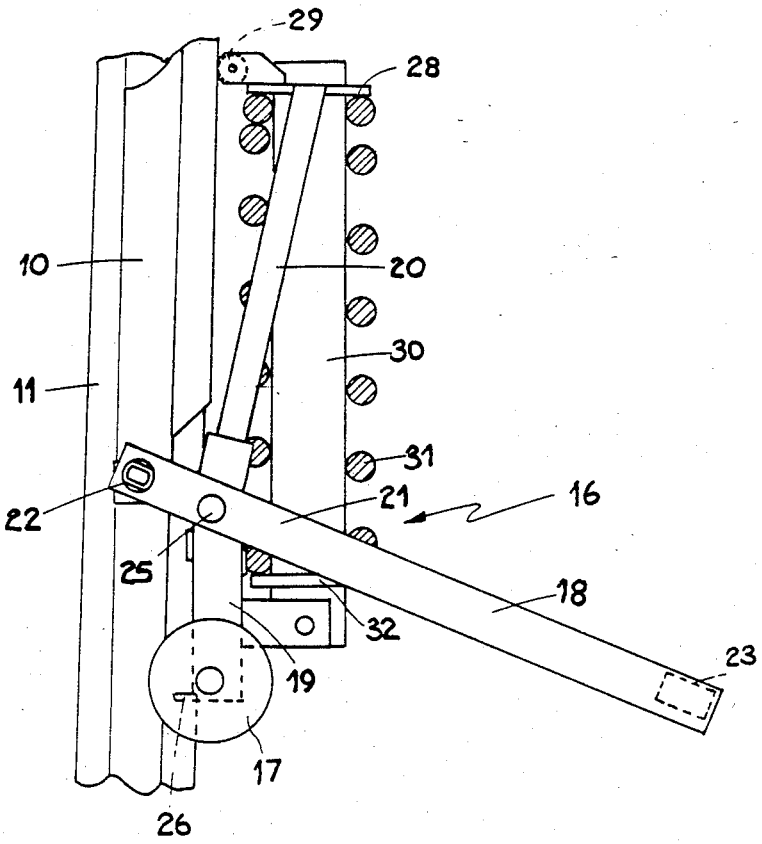
FIG. 4 shows a lowering device when attached to the appliance.

FIG. 4 illustrates a counterbalance unit 16 which is employed to lower the column part 10 in the above-described manner, and to raise the column part 10 back into an upright position. The counterbalance unit 16 is in the form of a trolley having a pair of wheels 17 (only one of which is visible), the trolley also including a bifurcated lever 18, a base part 19 and a pair of arm members 20 (only one shown). The lever 18 is composed of a pair of arms 21 (again, only one shown) whose lateral spacing is such as to enable them to embrace the column at the pivot 12. At one end the arms 21 are provided with respective tubular apertures 22 (see also FIG. 5) which can be axially aligned with the ends of the pivot shaft 13 respectively, while at their other ends the arms 21 are interconnected by a cross-member 23 which forms a foot pad. The arms 21 can be attached to the upper column part 10 in a manner to be described later by inserting an operating handle 24, shown in detail in FIG. 6, through the apertures 22 and through the interior of the pivot shaft 13.

The base part 19 of the trolley is pivotally connected to the arms 21 of the lever 18 at points 25 respectively spaced from the tubular apertures 22. At an end thereof remote from the connection 25, the base part 19 carries the aforementioned wheels 17 and also mounts a projection 26. In operation, this projection locates in a corresponding slot 27 formed in the column part 11, this slot being shown to advantage in FIGS. 1 and 2.

The arm members 20 are also pivotally connected to the arms 21 of the lever 18 at the points 25 and extend upwardly therefrom, being connected at their upper ends by a compression plate 28. A roller 29 is carried by the plate 28 for engagement with the column part 10 in the manner indicated in FIG. 4. The plate 28 is mounted for upward and downward sliding movement on a barrel 30 which at its lower end is pivotally secured to the base part 19. A compression spring 31 surrounds the barrel 30 and is received between the compression plate 28 and a flange 32 fixed to the barrel: the spring thus opposes movement of the plate 28 towards the flange 32.

In order to lower the column part 10, the counterbalance unit 16 is positioned with the projection 26 engaging in the slot 27 in the column part 11 and with the roller 29 in engagement with the column part 10. At the same time, the tubular apertures 22 are aligned with the hollow pivot shaft 13 and the operating handle 24 is inserted therethrough, thereby attaching the arms 21 to the upper column part 10. A locking device (to be described later) is then released to enable the column part 10 to be displaced vertically relative to the column part 11, whereupon downward foot pressure is applied to the cross member 23. Initially, this will cause the lever 18 to pivot about the apertures 22 to urge the roller 29 into close contact with the upper column part 10. Continued downward pressure on the cross-member 23 will then cause the lever 18 to pivot about the connection points 25, thereby raising the apertures 22 and hence the operating handle 24 and the pivot shaft 13. This action has the effect of displacing the column part 10 upwardly into its release position. The locking device is then operated to hold the column part 10 in the release position, whereupon pivotal lowering of the column part 10 can commence. During such pivotal lowering, the engagement of the roller 29 with the column part 10 causes the arm members 20 to pivot relative to the base part 19 of the counterbalance unit 16, thereby compressing the spring 31: the spring thus absorbs at least a proportion of the weight of the column part 10 as it is lowered. The column part 10 can be restored to its operative position by reversing the sequence of operations described above.

As indicated above, a locking device is provided to lock the upper column part 10 at each end of its limited vertical displacement relative to the lower column part 11. This locking device is in fact constituted by the pivot shaft 13 and the slots 14 as follows. As can be seen to advantage in FIG. 7, each of the slots 14 is configurated so that it comprises a pair of relatively wide portions 33 interconnected by a relatively narrow portion 34. More particularly, each of the relatively wide portions 33 has a side wall which is generally part-circular in shape but which has a slot **33*a* at a position opposed to the relatively narrow portion 34, while the latter portion has a pair of generally parallel, laterally spaced side walls. The pivot shaft 13 has an external surface which is generally circular in cross-section but which has two diametrically opposed flats 13*a* thereon: the overall diameter of the shaft 13 is greater than the lateral spacing of the side walls of the narrow slot portion 34, while the distance between the flats 13*a* is slightly less than this lateral spacing. The pivot shaft 13 is rotatable between a first orientation (as shown in FIG. 7) wherein the flats 13*a* are oriented generally perpendicularly to the side walls of the narrow slot portion 34, and a second orientation (as shown in FIG. 8) wherein the flats 13*a* are oriented parallel to those side walls. Thus the pivot shaft 13 can pass along the narrow slot portion 34 from one wide slot portion 33** to the other only when in its second orientation.

When the upper column part 10 is at the bottom end of its limited vertical displacement (i.e. in the lock position), the pivot shaft 13 locates in the lowermost portion 33 of each slot 14, whereas it locates in the uppermost portion 33 when the upper column part 10 is at the top end of its limited vertical displacement (i.e. when in the release position). In order that the column part 10 can be displaced vertically, the pivot shaft 13 must be turned into its second orientation so that it may pass through the narrow portions 34 of the slots 14. Thus, when the pivot shaft 13 is located in the uppermost portion 33 of each slot 14 and is in its first orientation (as indicated in FIG. 9), the upper column part 10 will be locked in its release position.

Figure 6:
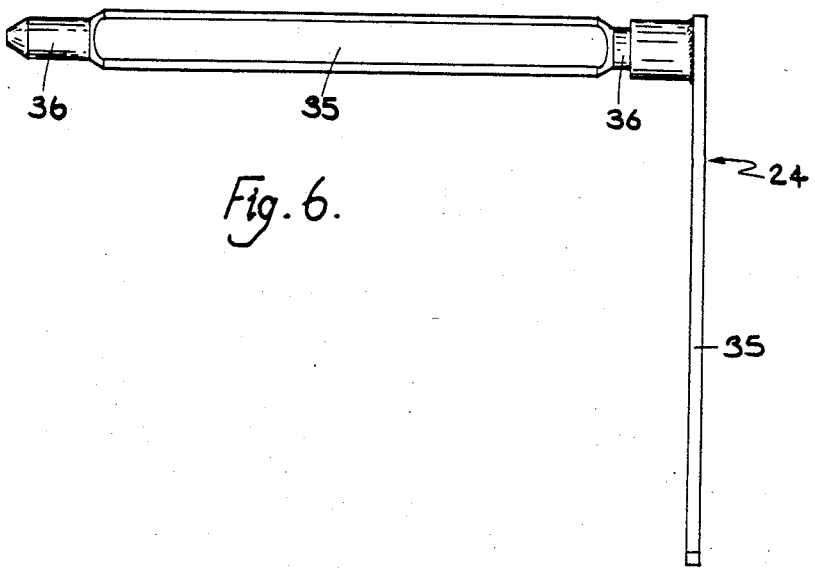
FIGS. 5 and 6 show in detail parts of the lowering device.

Rotation of the pivot shaft 13 relative to the column part 10 is achieved by means of the aforementioned operating handle 24. As can be seen in FIG. 6, the handle includes a key shaft having a central portion 35 whose cross-section corresponds to the internal cross-section of the pivot shaft 13, the portion 35 being flanked by portions 36 of circular cross-section. Reference numeral 37 denotes a part of the handle which can be manually grasped in use.

Figure 5:
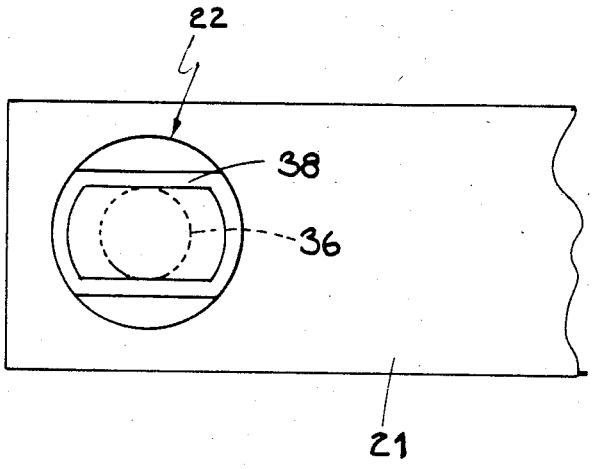

Referring now to FIG. 5, the tubular aperture 22 in each arm 21 of the counterbalance unit 16 is flattened at 38, so that the shape of the aperture conforms to the internal cross-section of the pivot shaft 13. When the counterbalance unit is initially mounted on the column (i.e. when the upper column part 10 is at the lower end of its limited vertical displacement relative to the lower column part 11), the apertures 22 are congruent with the interior of the pivot shaft 13 so that the key shaft of the operating handle 24, in the appropriate rotational orientation, can be inserted through one of the apertures 22, through the interior of the pivot shaft 13, and through the other aperture 22. When the operating handle has been fully inserted, the circular portions 36 of the key shaft rest within the apertures 22 (as indicated in broken line in FIG. 5), thereby enabling the operating handle to be turned within the apertures. Once the operating handle has been rotated to move the pivot shaft 13 into the orientation shown in FIG. 8, the non-circular cross-section of the key shaft portion 35 together with the non-circular cross-section of the aperture 22 through which the operating handle is inserted, ensure that the operating handle cannot inadvertently be removed. Although this effect can be achieved by making the aperture 22 in only one of the arms 21 non-circular, it is preferred that the apertures in both arms are so shaped, because then the operating handle can be inserted from either side of the column, thereby greatly facilitating operator convenience.

As mentioned previously, FIG. 9 illustrates the situation where the upper column part 10 has been displaced upwardly into its release position and the pivot shaft 13 has been turned into its first orientation, thereby to lock the upper column part in the release position. At this point, one of the flats 13*a* on the pivot shaft 13 is juxtaposed with the flat 33*a* on the uppermost slot portion 33. As the upper column part 10 is subsequently lowered, the roller 29 on the counterbalance unit 16 acts as a fulcrum, as a result of which the flat 13*a* is urged into frictional contact with the flat 33*a*, thereby preventing the pivot shaft from rotating relative to the lower column part 11. If such rotation were to occur, then there would be a danger of the pivot shaft 13 reaching its second orientation and being able to return prematurely to the lowermost slot portion 33, with the result that the lip 15 on the column part 10 would foul the upper end of the column part 11 when an attempt was subsequently made to return the column part 10 an upright position. Thus, the provision of the flats 13*a* and 33*a* prevent this from happening.

When the column is in its normal upright condition, one of the flats 13*a* on the pivot shaft is similarly urged into frictional contact with the flat 33*a* on the lowermost slot portion 33, this time by the weight of the upper column part 10 itself. This action serves to prevent rotational "creep" of the pivot shaft as the upper column part 10 is subjected to wind buffeting during normal usage, so that the key shaft of the operating handle 24 can always readily to passed through the apertures 22 in the counterbalance unit and the interior of the pivot shaft 13.

Figure 4A:
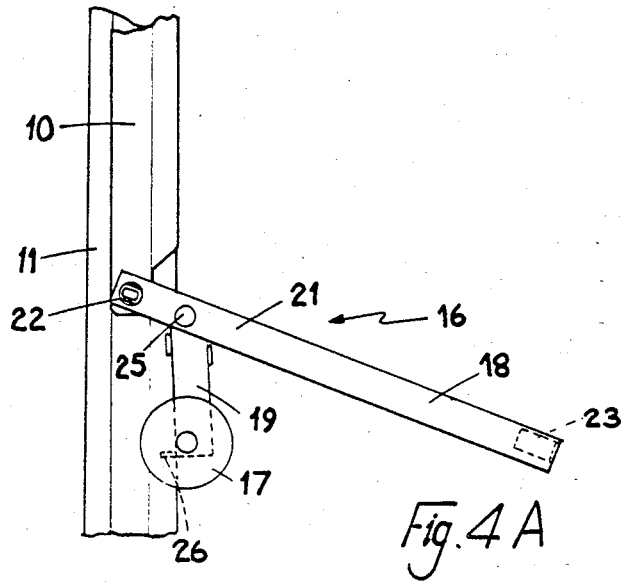
FIG. 4A and 4B are similar views to FIG. 4, but showing alternative forms of lowering device.
Figure 4B:
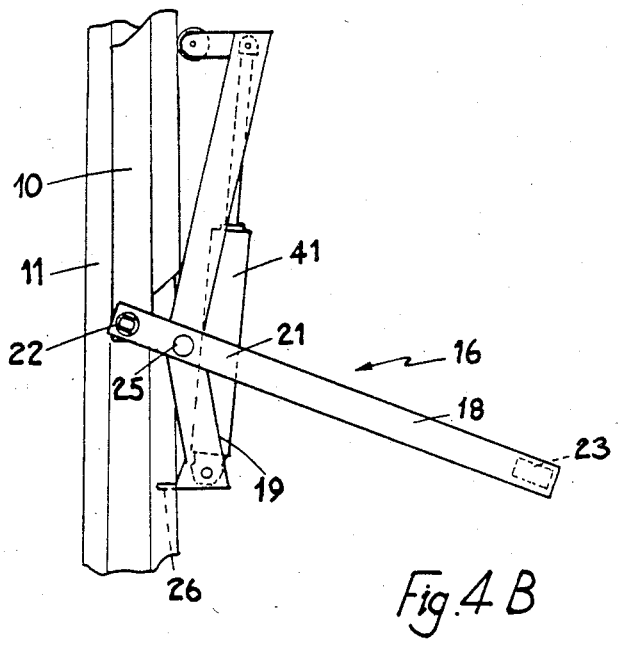

In the above description, it has been assumed that the column part 10 is sufficiently heavy as to require the provision of a compression spring 31 in the counterbalance unit 16 to take the weight of the column part 10 as it is lowered. For relatively lightweight columns (for example, those less than 5 meters in height), the spring 31 is not necessary and can therefore be omitted along with its associated parts, in which case the counterbalance unit will take the form illustrated in FIG. 4A. On the other hand, for columns which are rather heavier than that illustrated, a small hydraulic ram can be employed in place of the compression spring 31, for example as illustrated at 41 in FIG. 4B.

Figure 10:
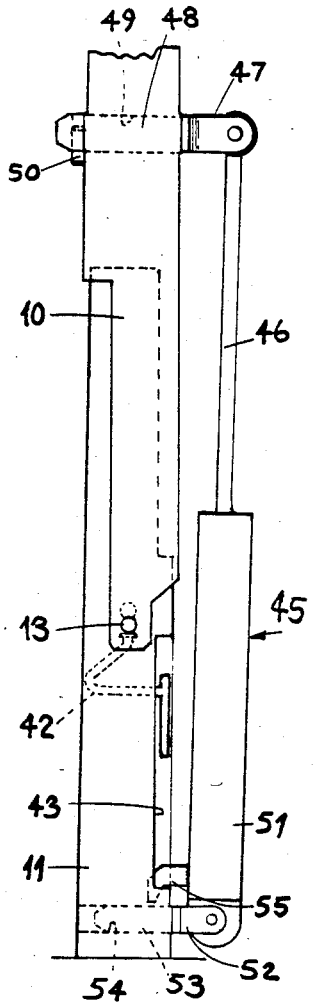
FIG. 10 is a side view of part of a second embodiment of a column-mounted appliance according to the present invention.
Figure 11:
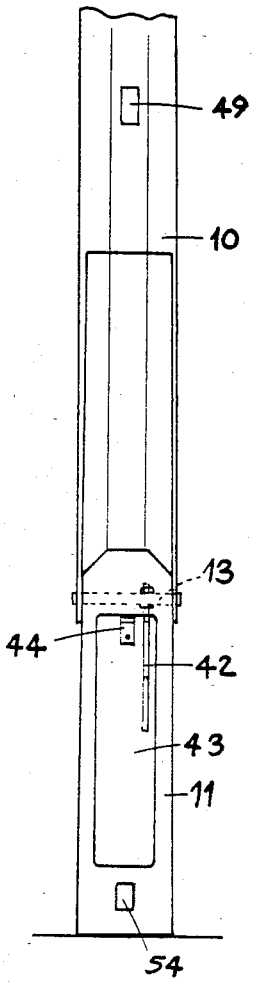
FIG. 11 is a front view of the appliance shown in FIG. 10.
Figure 12:
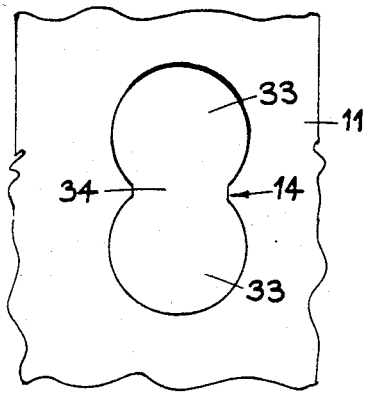
FIG. 12 shows a detail of the appliance illustrated in FIGS. 10 and 11.

An alternative arrangement for use with heavier columns is shown in FIGS. 10 to 12. In this arrangement, the pivot shaft 13 is now made solid and has secured thereto an operating handle 42 which is disposed in the interior of the lower column part 11. An opening 43 is formed in the column part 11 to enable access to be gained to the interior of the latter, and a cover (not shown) is detachably mountable on the column part 11 to cover the opening 43, the cover being secured in use to a lug 44 which extends into the opening. When the cover is in position over the opening 43, it obstructs the handle 42 and thereby prevents the pivot shaft 13 from being rotated into its aforesaid second orientation. Accordingly, rotational "creep" of the pivot shaft 13 is prevented under these circumstances, and there is no need to provide the lowermost portion 33 of each slot 14 with a flat 33*a* as described in relation to the embodiment of FIGS. 1 to 9.

The counterbalance unit now comprises simply an hydraulic ram 45 whose ends are connectible to the upper and lower column parts, respectively. More particularly, a piston rod 46 of the ram has its free end pivotally received between the limbs of a first bifurcated jacking lug 47. This lug can be attached to the upper column part 10 by inserting a stem portion 48 thereof through a passage 49 in the column part 10 until an end of the stem portion 48 projects from the opposite side of the column part 10. A plunger 50 is slidably housed in a bore in the stem portion 48, and can be extended from the latter in order to secure the lug 47 in position. A cylinder 51 of the hydraulic ram 45 has a base portion thereof pivotally received between the limbs of a second bifurcated jacking lug 52. This lug can be attached to the lower column part 11 by inserting a stem portion 53 thereof into a passage 54 provided at the base of the column part 11. The base portion of the cylinder 51 also has a hook-shaped projection 55 formed thereon which locates over a bottom edge of the aforesaid opening 43 in the lower column part 11. This projection is obstructed by the aforementioned cover in the event that an attempt is made to mount the hydraulic ram 45 on the column without first uncovering the opening. Hence, it will be appreciated that the cover 44 must be removed on the one hand to enable the hydraulic ram 45 to be attached to the column, and on the other hand to allow the operating handle 42 to be moved sufficiently far to place the pivot shaft 13 in its said second orientation.

Lowering of the upper column part 10 is performed in an analagous manner to that explained previously, except that the column part 10 is moved through its limited vertical displacement relative to the column part 11 by suitable operation of the hydraulic ram 45, rather than by foot operation of the counterbalance unit 16. Thus, in order to move the column part 10 into its release position, the hydraulic ram 45 is pressurised so as to extend the piston rod 46 relative to the cylinder 51. To prevent the pivot shaft 13 from locking in the event that the ram 45 is over pressurised (which would otherwise prevent the upper column part from being pivotally lowered), the flat 33*a* is omitted from the uppermost portion 33 of each slot. Thus, each slot 14 now has a configuration as illustrated in FIG. 12, and in particular the relatively wide portions 33 now have side walls which are almost completely circular.

In the illustrated embodiments, the column parts 10 and 11 are shown as being of octagonal cross-section. It is to be appreciated however that these column parts could equally well be of circular cross-section, for example.

I claim:

1. A column-mounted appliance comprising a column composed of a lower column part and an upper column part, a generally horizontal pivot by means of which said upper column part is connected to said lower column part for pivotal lowering and raising movement relative thereto, an applicance mounted on said upper column part, means permitting said upper column part to be moved relative to said lower column part through a limited vertical displacement between a lock position and a release position, a mechanical interlock operative to prevent said upper column part from being pivotally lowered about said generally horizontal pivot unless said upper column part is first moved through said limited vertical displacement into said release position, and a releasable locking device operable to hold said upper column part in said release position during pivotal lowering and raising of said upper column part, said locking device being composed of normally vertically disposed closed ended configurated slot means provided in one of said upper and lower column parts and a shaft rotatably mounted on the other of said upper and lower column parts, the configurated slot means including a relatively narrow portion and a first relatively wide portion, said shaft being received in the configurated slot means and being moved from one of said relatively narrow and wide portions to the other as said upper column part is moved between said lock and release positions, said shaft having an external surface which is non-circular in cross-section and being rotatable relative to said other of said column parts between a first rotational position wherein said shaft can enter said relatively narrow portion of the configurated slot means and a second rotational position wherein said shaft cannot enter said relatively narrow portion.

2. The column-mounted appliance according to claim 1, wherein the configurated slot means includes a second relatively wide portion, said relatively narrow portion interconnects said first and second relatively wide portions, and said shaft is disposed in one of said relatively wide portions when said upper column part is in said lock position and in the other of said relatively wide portions when said upper column part is in said release position.

3. The column-mounted appliance according to claim 1, wherein said relatively wide portion of the configurated slot means has a flat end wall and side walls which are generally part-circular in shape, said relatively narrow portion of the configurated slot means has a pair of side walls which are mutually parallel and laterally spaced apart by a predetermined spacing, and said external surface of said shaft has a cross-sectional shape which is defined generally by a circle which has a diameter greater than said predetermined spacing and a pair of diametrically opposed flats which are spaced apart by a distance less than said predetermined spacing, said shaft being in said first rotational position when said flats are oriented parallel to said side walls of said relatively narrow portion of the configurated slot means.

4. The column-mounted appliance according to claim 1, wherein said shaft is constituted by said generally horizontal pivot.

5. The column-mounted appliance according to claim 4, further comprising anti-rotation means operative to prevent said shaft from rotating relative to the configurated slot means during pivotal lowering and raising of said upper column part.

6. The column-mounted appliance according to claim 5, wherein said shaft locates in said relatively wide portion of the configurated slot means when said upper column part is in said release position, and said anti-rotation means comprises a first flat provided on said external surface of said shaft and a second flat provided on a side wall of the configurated slot means, said first and second flats being mutually engaged when said shaft is in said second rotational position.

7. The column-mounted appliance according to claim 1, further comprising an operating handle which is operable to rotate said shaft relative to said other of said column parts.

8. The column-mounted appliance according to claim 7, wherein said lower column part is hollow and has an interior, an opening is formed in said lower column part and allows access to be gained to said interior thereof, and said operating handle is secured to said shaft and is disposed in said interior of said lower column part.

9. The column-mounted appliance according to claim 8, further comprising a cover and means enabling said cover to be removably secured to said lower column part to cover the opening therein, said cover obstructing movement of said operating handle to rotate said shaft when said cover is secured to said-lower column part.

10. The column-mounted appliance according to claim 7, wherein said shaft is hollow and has an interior which is of non-circular cross-section, and said operating handle includes a key portion of corresponding non-circular cross-section which can be removably inserted into said interior of said shaft.

11. The column-mounted appliance according to claim 10, further comprising a lowering device which is attachable to said column to assist in pivotally lowering said upper column part relative to said lower column part, and wherein said operating handle forms part of said lowering device.

12. The column-mounted appliance according to claim 11, wherein said lowering device includes a component having an aperture therein through which said operating handle can be inserted, the aperture being aligned with said shaft interior when said lowering device is attached to said column, the aperture having a shape which corresponds to said non-circular cross-section of said shaft interior and which is congruent therewith when said shaft is in one of said first and second rotational positions, and said operating handle has a portion of circular cross-section which is received in the aperture when said key portion is inserted in said shaft interior.

13. The column-mounted appliance according to claim 1, further comprising a lowering device which can be attached to said column to assist in pivotally lowering said upper column part relative to said lower column part.

14. The column-mounted appliance according to claim 13, wherein said lowering device comprises a fluid-operated ram having a piston and a cylinder, first attachment means enabling one of said piston and said cylinder to be attached to said upper column part, and second attachment means enabling the other of said piston and said cylinder to be attached to said lower column part.

15. The column-mounted appliance according to claim 14, wherein said lower column part is hollow and has an interior, an opening is formed in said lower column part and allows access to be gained to said interior thereof, a cover is removably secured to said lower column part to cover the opening, and said second attachment means of said lowering device includes a projection which extends into the opening in said lower column part, whereby said cover obstructs said projection and thereby prevents said one of said piston and cylinder from being attached to said lower column part unless said cover is first removed from the opening.

16. The column-mounted appliance according to claim 15, wherein the opening has a bottom edge, and said projection is formed by a hook which hooks over said bottom edge.

17. The column-mounted appliance according to claim 13, wherein said lowering device includes a first attachment portion which is attachible to said upper column part, a second attachment portion which is attachible to said lower column part, a lever on which said first attachment portion is mounted, and pivot means enabling said lever to be pivoted relative to said second attachment portion, whereby when said lowering device is attached to said column, pivotal movement of said lever relative to said second attachment portion causes said upper column part to move between said lock and release positions.

18. The column-mounted appliance according to claim 17, wherein said lever has an end on which said first attachment portion is provided, and said pivot means is provided at a point spaced from said end of said lever.

19. The column-mounted appliance according to claim 17, wherein said lower column part has a slot therein, and said second attachment portion comprises a projection which is engageable in the slot.

20. The column-mounted appliance according to claim 17, wherein said lever has mounted thereon a foot-operable pad, whereby said lever can be pivoted relative to said second attachment portion by foot pressure applied to said pad.

21. The column-mounted appliance according to claim 17, wherein said generally horizontal pivot includes a pivot shaft mounted on said upper column part, and said first attachment portion of said lowering device comprises a pair of arms which are engageable respectively with opposite ends of said pivot shaft.

22. The column-mounted appliance according to claim 21, wherein said pivot shaft is hollow and has an interior, each of said arms has an aperture therein which is aligned with said shaft interior when said lowering device is attached to said column, and said lowering device further comprises key means which is insertible through the apertures into said shaft interior.

23. The column-mounted appliance according to claim 1, wherein said configurated slot means is provided in said lower column part, and said shaft is mounted on said upper column part.

24. A column-mounted appliance comprising a column composed of a lower column part and an upper column part, a generally horizontal pivot by means of which said upper column part is connected to said lower column part for pivotal lowering and raising movement relative thereto, an appliance mounted on said upper column part, means permitting said upper column part to be moved relative to said lower column part through a limited vertical displacement between a lock position and a release position, a mechanical interlock opertive to prevent said upper column part from being pivotally lowered about said generally horizontal pivot unless said upper column part is first move through said limited vertical displacement into said release position, and a lowering device attachable to said column to assist in pivotally lowering said upper column part, said lowering device including a lever having a first attachment positio at one end thereof and a footpad at the other end thereof, said first attachment portion being attachable to said upper column part, a base part having a second attachment portion which is attachable to said lower column part, and pivot means connecting said base part to said lever at a point intermediate said first attachment portion and said footpad, whereby when said lowering device is attached to said column, foot pressure on said footpad causes said lever to pivot relative to said base part and thereby raise said first attachment portion to move said upper column part from said lock position to said release position.

* * * * *